US006592061B2

(12) United States Patent
Watajima et al.

(10) Patent No.: US 6,592,061 B2
(45) Date of Patent: Jul. 15, 2003

(54) ROLL CRUSHER

(75) Inventors: Teruji Watajima, Takeo (JP); Noriaki Nakamura, Saga (JP); Akira Matsuo, Sayama (JP); Kenichiro Dan, Saga (JP); Yasutaka Yamamoto, Tokyo (JP)

(73) Assignee: Nakayama Iron Works, Ltd., Takeo (JP)

( * ) Notice: Subject to any disclaimer, the term of this patent is extended or adjusted under 35 U.S.C. 154(b) by 6 days.

(21) Appl. No.: 09/820,941

(22) Filed: Mar. 30, 2001

(65) Prior Publication Data

US 2001/0045477 A1 Nov. 29, 2001

(30) Foreign Application Priority Data

May 29, 2000 (JP) ..... 2000-158379

(51) Int. Cl.[7] ..... B02C 13/28
(52) U.S. Cl. ..... 241/191; 241/294
(58) Field of Search ..... 241/293, 294, 241/189.1, 191

(56) References Cited

U.S. PATENT DOCUMENTS

| | | | | |
|---|---|---|---|---|
| 1,920,946 A | * | 8/1933 | Armstrong | 241/194 |
| 4,344,581 A | | 8/1982 | Redemann | 241/88.4 |
| 5,114,085 A | * | 5/1992 | Inui | 241/195 |
| 5,413,286 A | * | 5/1995 | Bateman | 241/190 |

FOREIGN PATENT DOCUMENTS

| | | |
|---|---|---|
| DE | 511 148 C | 10/1930 |
| DE | 29 43 567 A1 | 4/1981 |
| GB | 311 913 A | 5/1929 |
| JP | 5-309282 | 11/1993 |
| JP | 9-187670 | 7/1997 |
| JP | 9-253511 | 9/1997 |
| JP | 10-296106 | 11/1998 |
| JP | 11-319595 | 11/1999 |

* cited by examiner

*Primary Examiner*—Mark Rosenbaum
(74) *Attorney, Agent, or Firm*—Armstrong, Westerman & Hattori, LLP

(57) ABSTRACT

When material is thrown in a hopper, material of small particle diameter is loaded in between breaking teeth on two rotors and transferred toward a crushing space between the rotors by rotation. The material of small particle diameter is pressed by compression teeth on one rotor against cutting teeth on the other rotor, thereby causing compressive crushing. When material of small particle diameter clogs the crushing space and stays therein, the cutting teeth cut the material to form a gap. The breaking teeth on the two rotors move odd-shaped material or the like toward the crushing space by similar action. Consequently, the odd-shaped material assumes such a posture that it is caught between the breaking teeth, and is crushed by the breaking teeth or cut by the wedge effect.

2 Claims, 6 Drawing Sheets

(a)

(b)

ROLL CRUSHER

BACKGROUND OF THE INVENTION

1. Field of the Invention

The present invention relates to a roll crusher for breaking concrete, asphalt and natural stone into lumps of predetermined size. More particularly, the present invention relates to a roll crusher for breaking scrap pieces of concrete, asphalt, etc. produced during repair, reconstruction and so forth of roads, concrete structures, etc. for the purpose of recycling, or for crushing natural stone into lumps of predetermined size.

2. Discussion of Related Art

A large amount of scrap concrete and asphalt is produced as industrial waste by reconstruction of buildings and road repairing work. These scrap pieces have heretofore been subjected to reclaiming disposal. However, the number of reclaiming disposal sites is decreasing because of environmental destruction and other problems. Therefore, it is desired that scrap concrete and asphalt be reused. Under these circumstances, a breaking machine has recently been developed which is designed to crush and break scrap pieces of concrete or the like into lumps of predetermined size and to crush them with rotating rotary teeth with a view to recycling (e.g. Japanese Patent Application Unexamined Publication (KOKAI) No. Hei 5-09282).

The inventors of the present invention also proposed roll crushers having rotating rotary teeth (e.g. Japanese Patent Application Unexamined Publication (KOKAI) No. Hei 11-319596 and Japanese Patent Application No. Hei 11-143936).

However, because scrap pieces of concrete are irregular in size and thickness, if cast into a breaking machine, they are not readily crushed into lumps of appropriate size. During crushing, concrete scrap pieces may be caught in the gap between the rotating rotors, causing the rotors to become unable to rotate. In addition, the crushing teeth are worn by pieces of concrete thrown in, and breaking teeth provided on the outer peripheries of the rotors wear out at a high rate. Consequently, it is necessary to replace the rotors or to subject them to build-up welding. This causes costs to increase.

The conventional crushers use breaking teeth having a single function, which are disposed on the outer periphery of a cylindrical rotor body. This may cause clogging with the material. That is, because breaking teeth having the same shape and the same function are simply arranged side by side, the teeth may turn free without biting into material when its shape is close to that of a large ball, for example.

SUMMARY OF THE INVENTION

The present invention was made in view of the above-described problems with the prior art. Accordingly, the present invention attains the following objects.

An object of the present invention is to provide a roll crusher that is unlikely to become unable to rotate regardless of the shape and size of material to be crushed.

Another object of the present invention is to provide a roll crusher capable of automatically moving material cast therein to a crushing area without guiding it.

A further object of the present invention is to provide a roll crusher capable of crushing material with different crushing functions.

A further object of the present invention is to provide a roll crusher having a fixing mechanism capable of firmly fixing breaking teeth to a rotor body.

To attain the above-described objects, the present invention provides a roll crusher having a plurality of kinds of crushing teeth for crushing a material to be crushed on the outer periphery of a rotor driven to rotate. The roll crusher includes a cylindrical rotor body and a plurality of breaking teeth for crushing the material mainly by a wedge effect. The breaking teeth are installed on the outer periphery of the rotor body. Each breaking tooth has a pair of wedge surfaces contiguous to each other with an angle converging in a rotational direction. A plurality of compression teeth for crushing the material mainly by a compressive effect are installed on the outer periphery of the rotor body. Each compression tooth has a plane portion. Further, a plurality of cutting teeth for crushing the material mainly by cutting are installed on the outer periphery of the rotor body. Each cutting tooth has a cutting edge.

The breaking teeth, the compression teeth and the cutting teeth are preferably different in the radial height from the outer peripheral surface of the rotor body.

In addition, the present invention provides a roll crusher having a plurality of kinds of crushing teeth for crushing a material to be crushed on the outer periphery of a rotor driven to rotate. The roll crusher includes a cylindrical rotor body and a plurality of breaking teeth for crushing the material mainly by a wedge effect. The breaking teeth are installed on the outer periphery of the rotor body. Each breaking tooth has a pair of wedge surfaces contiguous to each other with an angle converging in a rotational direction. A plurality of crushing teeth are installed on the outer periphery of the rotor body. The crushing teeth are lower than the breaking teeth in the radial height from the outer peripheral surface of the rotor body. A crushing chamber is open at a portion thereof directly above the rotor body so that the material to be crushed is loaded onto the outer peripheral surface of the rotor body.

The term "crushing teeth" means teeth for crushing mainly by cutting-off, crushing by bending, compressive crushing, and crushing by cutting away. It should be noted that in the case of a roll crusher having a plurality of rotor bodies, the crushing chamber may be open at a portion thereof directly above only one of the rotor bodies.

In addition, the present invention provides a roll crusher having a plurality of kinds of crushing teeth for crushing a material to be crushed on the outer periphery of a rotor driven to rotate. The roll crusher includes a cylindrical rotor body driven to rotate. The rotor body has breaking tooth fixing holes radially extending therethrough. The roll crusher further includes a plurality of breaking teeth for crushing the material mainly by a wedge effect. The breaking teeth have insert portions inserted and fixed in the breaking tooth fixing holes, respectively. Each breaking tooth has a pair of wedge surfaces contiguous to each other with an angle converging in a rotational direction. Breaking tooth mounting cotters are installed between the insert portions of the breaking teeth and the side walls of the breaking tooth fixing holes, respectively. The roll crusher further includes cotter fixing members for immovably fixing the breaking tooth mounting cotters.

The roll crusher may further include engagement portions formed in the breaking tooth fixing holes for engagement with the cotter fixing members and bolts for integrally connecting the cotter fixing members and the breaking tooth mounting cotters.

The above and other objects, features and advantages of the present invention will become more apparent from the following description of the preferred embodiments thereof, taken in conjunction with the accompanying drawings.

BRIEF DESCRIPTION OF THE DRAWINGS

FIGS. 4(*a*), 4(*b*) and 4(*c*) are diagrams showing the shape of breaking teeth, of which: FIG. 4(*a*) is a plan view; FIG. 4(*b*) is a front view; and FIG. 4(*c*) is a left-hand side view.

FIG. 5(*b*) is a vector diagram showing force applied laterally to a breaking tooth and reaction forces against it.

DESCRIPTION OF THE PREFERRED EMBODIMENTS

Embodiments of the roll crusher according to the present invention will be described below with reference to the accompanying drawings.

First Embodiment

Figure 1:
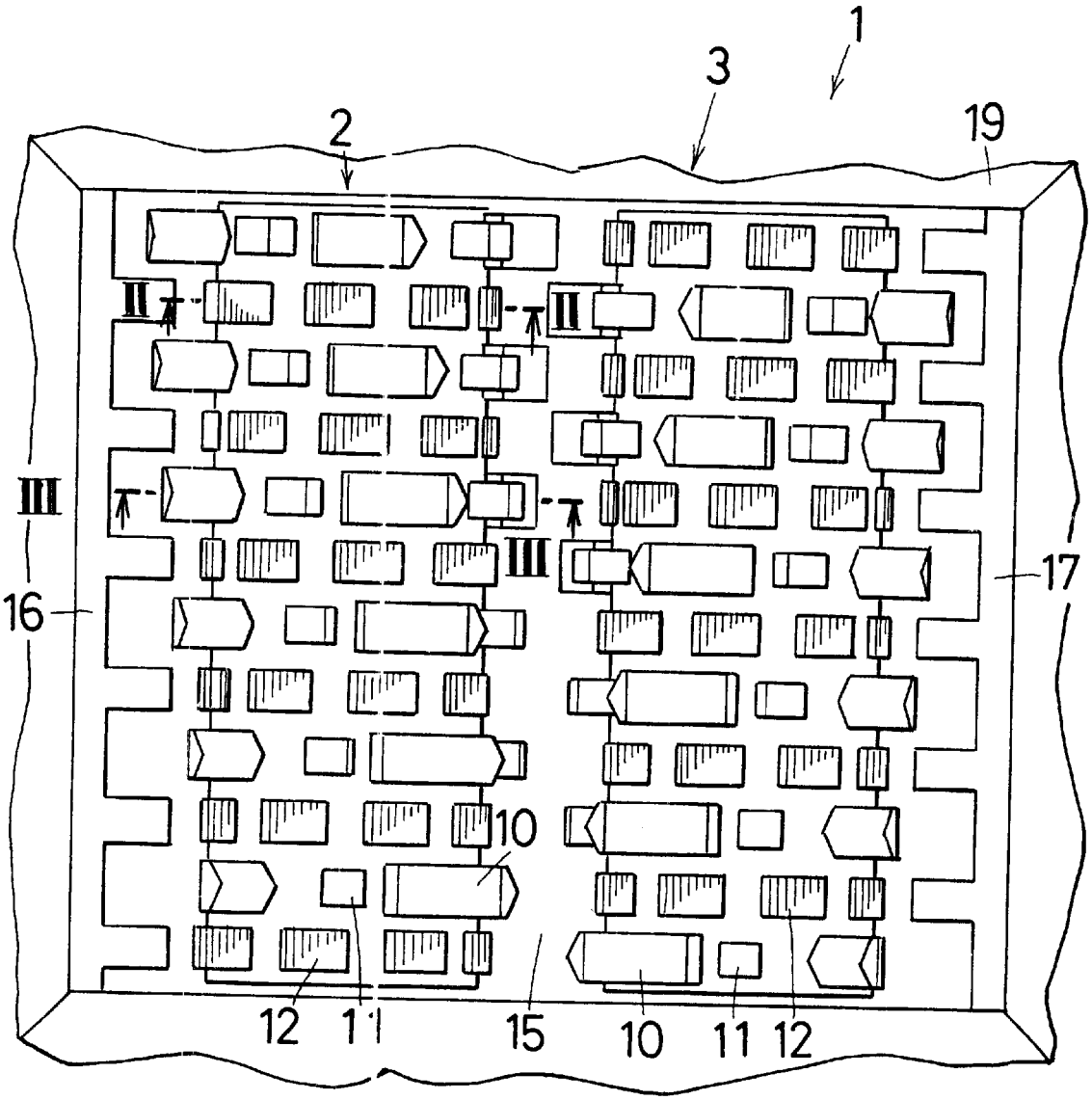
FIG. 1 is a plan view of an arrangement in which the present invention is applied to a roll crusher having rotors of twin-shaft type.
Figure 2:
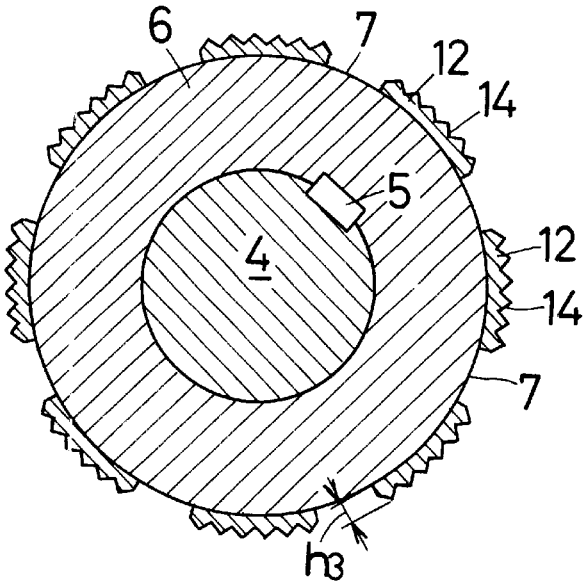
FIG. 2 is a sectional view taken along the line II—II in FIG. 1.
Figure 3:
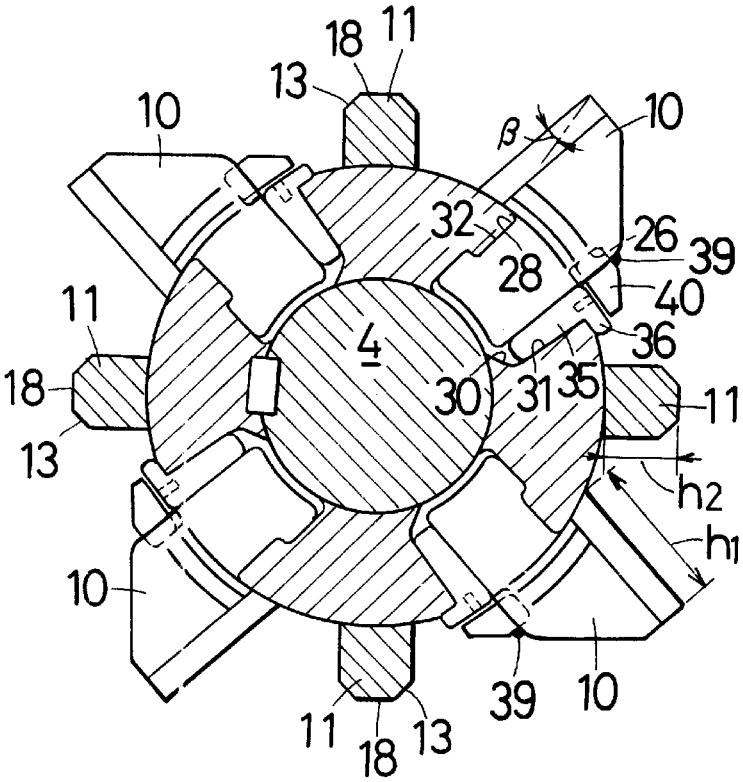
FIG. 3 is a sectional view taken along the line III—III in FIG. 1.

A first embodiment of the present invention will be described below with reference to the drawings. FIG. 1 is a plan view of the present invention as applied to a roll crusher having rotors of twin-shaft type. FIG. 2 is a sectional view taken along the line II—II in FIG. 1. FIG. 3 is a sectional view taken along the line III—III in FIG. 1. In a roll crusher 1, a first rotor 2 and a second rotor 3 are installed. A driving shaft 4 (see FIG. 2) of the first rotor 2 and a driving shaft (not shown) of the second rotor 3 are placed in parallel to each other. The first rotor 2 and the second rotor 3 have substantially the same structure. However, the first rotor 2 and the second rotor 3 are disposed to differ in phase in the axial direction of the driving shaft 4 so that crushing teeth thereof are staggered.

The structure of the first rotor 2 will be described below. The driving shaft 4 is a shaft connected to and driven by an electric motor or a hydraulic motor (not shown), for example, which is a rotational driving device. A first rotor body 6 is secured to the outer periphery of the driving shaft 4 through a key 5. Three kinds of crushing teeth, i.e. breaking teeth 10, compression teeth 11, and cutting teeth 12, are installed on an outer peripheral surface 7 of the first rotor body 6 so as to project at equiangular intervals, respectively.

The breaking teeth 10 are teeth for mainly biting and crushing large lumps of material to be crushed by the effect of wedge. The breaking teeth 10 are, as shown in FIG. 3, installed at equiangular intervals on the outer periphery of the first rotor body 6. In this example, four breaking teeth 10 are installed. The breaking teeth 10 are secured to the first rotor body 6 by a method described later. Of the three kinds of crushing teeth used in this example, the breaking teeth 10 project radially most from the outer peripheral surface 7 of the first rotor body 6. The compression teeth 11 are teeth for mainly crushing material by compression. The compression teeth 11 assist in biting into the material although they also have a crushing function. That is, each of the compression teeth 11 is disposed between two breaking teeth 10 as viewed in the axial direction of the driving shaft 4 and also has the function of assisting the breaking teeth 10 in biting into the material.

The compression teeth 11 are secured to the first rotor body 6 by welding them to the outer peripheral surface 7. The compression teeth 11 each have an approximately cubic shape with a plane portion 18 for mainly compressing the material. Each corner of each compression tooth 11 is chamfered at about 45 degrees as indicated by reference numeral 13. As shown in FIG. 3, the compression teeth 11 are installed at equiangular intervals on the outer periphery of the first rotor body 6 in such a manner that one compression tooth 11 is disposed between a pair of adjacent breaking teeth 10. In this example, four compression teeth 11 are installed. The cutting teeth 12 are used to cut the material little by little.

Each cutting tooth 12 has saw-toothed irregularities 14 formed on the outer periphery thereof as cutting edges. Material cast into the roll crusher 1 may remain uncrushed in a crushing chamber 8 without contacting any of the breaking teeth 10 and the compression teeth 11, depending on the shape of the material. Such material is cut little by little with the irregularities 14 of the cutting teeth 12 and eventually brought into contact with the breaking teeth 10 or the compression teeth 11 so as to be crushed.

The cutting teeth 12 are secured to the first rotor body 6 by welding them to the outer peripheral surface 7. In this example, eight cutting teeth 12 are installed at equiangular intervals (see FIG. 2). The heights of the three kinds of crushing teeth, i.e. the breaking teeth 10, the compression teeth 11, and the cutting teeth 12, from the outer peripheral surface 7 of the first rotor body 6 are related to each other as given by $h_1>h_2>h_3$, where $h_1$ is the height of the breaking teeth 10, $h_2$ is the height of the compression teeth 11, and $h_3$ is the height of the cutting teeth 12.

The greater the height of the crushing teeth, the more likely it becomes that the crushing teeth will come in contact with material cast into the crushing chamber 8, and the higher the probability the crushing teeth will crush the material. The arrangement of the crushing teeth on the second rotor 3 is the same as that of the crushing teeth on the first rotor 2, but the crushing teeth on the second rotor 3 are formed so that the axial positions of the crushing teeth do not face opposite to the corresponding crushing teeth on the first rotor 2. In other words, the cutting teeth 12 on the second rotor 3 are disposed to face the positions on the first rotor 2 where the breaking teeth 10 and the compression teeth 11 are installed.

The breaking teeth 10 and the compression teeth 11 on the second rotor 3 are disposed to face the positions on the first rotor 2 where the cutting teeth 12 are installed. Accordingly, a crushing space 15, which is the space between the first rotor 2 and the second rotor 3, is formed in a zigzag shape as seen in a plan view (see FIG. 1). It should be noted that the crushing space 15 can be changed by adjusting the spacing between the driving shaft 4 of the first rotor 2 and the driving shaft of the second rotor 3 through a spacing adjusting mechanism (not shown).

A hopper 19 is installed on the outer periphery of the top of the crushing chamber 8. The hopper 19 need not positively guide material into the crushing space 15, which is defined by an intermediate region between the first rotor 2 and the second rotor 3, as described later. In other words, a device for guiding material into the crushing space 15, such as a hopper, is not installed directly above the crushing chamber 8 and need not be disposed at such a position, as described later.

At both sides of the first rotor 2 and the second rotor 3, fixed tooth plates 16 and 17 are installed which have recesses and projections formed in correspondence to the height $h_1$ of the breaking teeth 10 and the height $h_3$ of the cutting teeth 12 so as to provide a uniform gap. The fixed tooth plate 16 is used when the machine is clogged with material and thus overloaded to crush the material between the first rotor 2 and the fixed tooth plate 16 by rotating the first rotor 2 in the reverse direction. Similarly, the fixed tooth plate 17 is used when the machine is clogged with material and thus overloaded to crush the material between the second rotor 3 and the fixed tooth plate 17 by rotating the second rotor 3 in the reverse direction.

Breaking Teeth 10 and Fixing Mechanism Therefor

Figure 4:
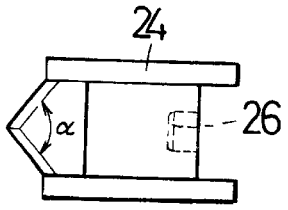
Figure 4:
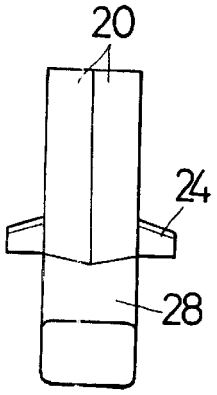
Figure 4:
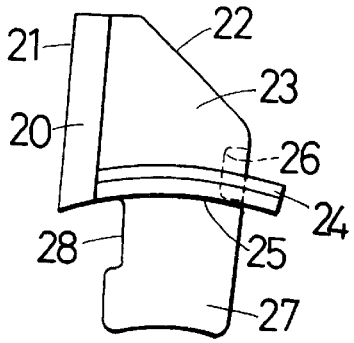

FIGS. 4(*a*), 4(*b*) and 4(*c*) are diagrams showing the shape of the breaking teeth 10. FIG. 4(*a*) is a plan view, and FIG. 4(*b*) is a front view. FIG. 4(*c*) is a left-hand side view. When the breaking teeth 10 are fixed on the first rotor body 6, an exposed portion 23 of each breaking tooth 10 is exposed on the outer peripheral surface 7 of the first rotor body 6. The exposed portion 23 has an odd shape. A wedge surface 20 of each breaking tooth 10 has a wedge angle $\alpha$, which is an obtuse angle.

The wedge angle $\alpha$ is provided to bite into material and crush it by the wedge effect. When the breaking teeth 10 are fixed on the first rotor body 6, an edge portion 21 of the wedge surface 20 forms a minus angle as a cutting edge angle $\beta$ with respect to the radial direction. Accordingly, when the breaking tooth 10 bites into material to crush it with the wedge angle $\alpha$, the wedge surface 20 produces a crushing action with the wedge angle $\alpha$ acting as a more acute angle than the apparent one.

The wedge surface 20 comes in contact with material mainly during forward rotation (which means rotation in the crushing direction in this case) and breaks and crushes it mainly by the wedge effect (biting into the material). At the back of the wedge surface 20, a chamfered portion 22 is formed at an angle of approximately 45 degrees with respect to the wedge surface 20. Skirt portions 24 are formed integrally with the exposed portion 23. The skirt portions 24 project from both sides of the bottom of the exposed portion 23. The reverse side of each skirt portion 24 forms a cylindrical surface 25. The cylindrical surface 25 has a curvature with which it is placed in close contact with the outer 4 peripheral surface 7 of the first rotor body 6.

The back of the wedge surface 20 is formed with a cotter mounting hole 26, which is a rectangular parallelepiped-shaped recess. The cotter mounting hole 26 is a hole for fixing a breaking tooth mounting cotter (described later). An approximately rectangular parallelepiped-shaped insert portion 27 is formed integrally with the bottom of the exposed portion 23. The insert portion 27 has an engagement recess 28 formed in the front thereof. The engagement recess 28 is engaged with the first rotor body 6 when the insert portion 27 is inserted thereinto.

The insert portion 27 of each breaking tooth 10 is secured by being inserted into a breaking tooth fixing hole 30 formed in the first rotor body 6. One side of the breaking tooth fixing hole 30 is formed with a slant surface 31 inclined with respect to the other side. A projection 32 is formed on the other side of the breaking tooth fixing hole 30 that faces opposite to the slant surface 31. When the insert portion 27 of the breaking tooth 10 is inserted into the breaking tooth fixing hole 30, the engagement recess 28 is engaged with the projection 32.

A breaking tooth mounting cotter 35 is inserted into the gap between the slant surface 31 of the breaking tooth fixing hole 30 and the insert portion 27 of the breaking tooth 10. The breaking tooth mounting cotter 35 has an L shape and is tapered at the distal end. Accordingly, when the breaking tooth mounting cotter 35 is forced into the gap between the insert portion 27 and the slant surface 31 of the breaking tooth fixing hole 30, the breaking tooth 10 is fixed in the breaking tooth fixing hole 30.

A collar portion 36 at the upper end of the breaking tooth mounting cotter 35 is in contact with the outer peripheral surface 7 of the first rotor body 6. A tapped hole 37 is formed in the top surface of the collar portion 36. The tapped hole 37 is used to pull out the breaking tooth mounting cotter 35 from the breaking tooth fixing hole 30 by screwing a bolt or the like into the tapped hole 37 and pulling it with a jig. Usually, the tapped hole 37 is not used; therefore, a screw is inserted therein to prevent dust from entering it.

It is also possible to remove the breaking tooth mounting cotter 35 by driving a chisel or the like into the area of contact between the collar portion 36 of the breaking tooth mounting cotter 35, which is beside the tapped hole 37, and the outer peripheral surface 7 of the first rotor body 6, instead of using a bolt for pulling out. In this case, no tapped hole is needed. The outer periphery of the top of the breaking tooth mounting cotter 35 is held with a cotter fixing member 40. The distal end of the cotter fixing member 40 is inserted into the cotter mounting hole 26. The cotter fixing member 40 and the breaking tooth 10 are secured together at a welded joint 39.

Crushing Resistance to Breaking Teeth 10

Figure 5:
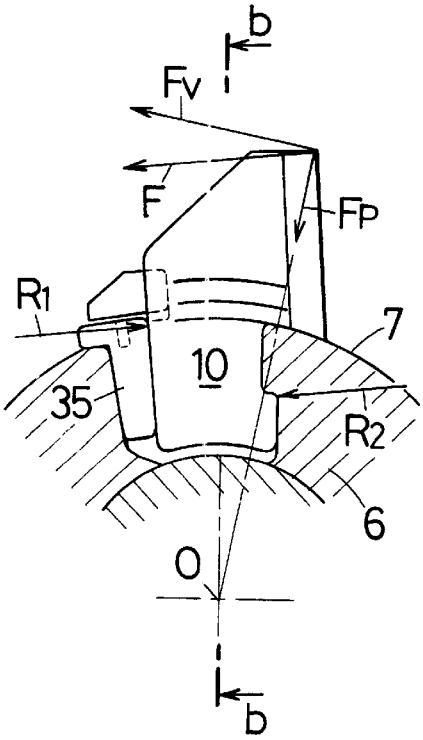
FIG. 5(*a*) is a vector diagram showing crushing resistance applied to a breaking tooth and components of the force, together with reaction forces against it.
Figure 5:
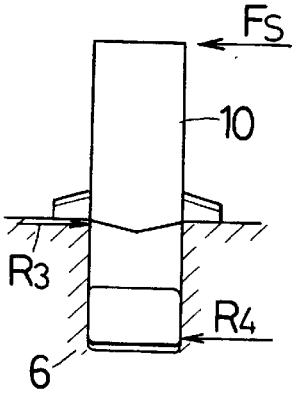

As shown in FIG. 5(*a*), because the first rotor body 6 is rotating, crushing resistance F applied to the wedge surface 20 acts not in the tangential direction to the breaking tooth 10 but in an oblique direction that is at an angle to the tangential direction in general. When the crushing resistance F acting on the breaking tooth 10 is resolved into three components of force, principal force $F_v$ (component of force in the crushing direction) relates to the driving torque and driving power of the roll crusher 1. Thrust force $F_p$ crushes or deforms material or the breaking tooth 10 although it does not consume power. The magnitude of principal force $F_v$ becomes smaller as the wedge angle $\alpha$ decreases or the crushing speed increases. The magnitude of thrust force $F_p$ tends to become smaller as the wedge angle $\alpha$ decreases.

Roughly speaking, moment due to crushing resistance F is borne by reaction force $R_1$ and reaction force $R_2$ at two points that are different in direction from each other. That is, reaction force $R_1$ arises at the outermost peripheral portion of the breaking tooth mounting cotter 35 at the back of the breaking tooth 10, and the other reaction force $R_2$ arises at the area of engagement between the engagement recess 28 of the breaking tooth 10 and the projection 32 of the breaking tooth fixing hole 30.

Thus, because reaction force to crushing resistance F is borne at two points away from the crushing resistance F, the fastening strength is higher than in a case where the breaking tooth 10 is fastened to the outer peripheral surface 7 by welding or the like. Further, when material is caught between two breaking teeth 10, for example, and crushing resistance $F_s$ is loaded to each breaking tooth 10 from the side as shown in FIG. 5(*b*), the crushing resistance $F_s$ is borne by reaction force $R_3$ and reaction force $R_4$ with a space therebetween. Therefore, it is also possible to ensure fastening strength against resistance applied from the side.

Operation

Figure 11:
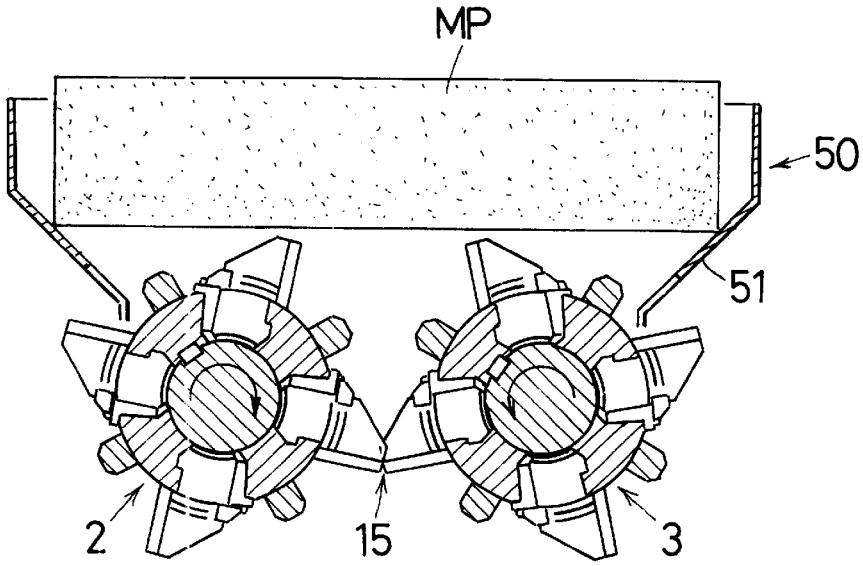
FIG. 11 is a sectional view illustrating the operation of the roll crusher according to the present invention when a hopper with the conventional structure is used.

Roughly speaking, the above-described roll crusher crushes material M by the operation stated below. FIG. 11 is a sectional view illustrating the operation of the roll crusher according to the present invention when a hopper with the conventional structure is used. For the sake of convenience, among cast materials, material having a relatively small particle diameter (including odd-shaped and plate-shaped materials) will be referred to as "small lump material MS", and large plate-shaped material will be referred to as "plate material MP". A hopper 50 has a bottom 51 drawn in the shape of a funnel to guide materials to the space between the first rotor 2 and the second rotor 3.

Figure 7:
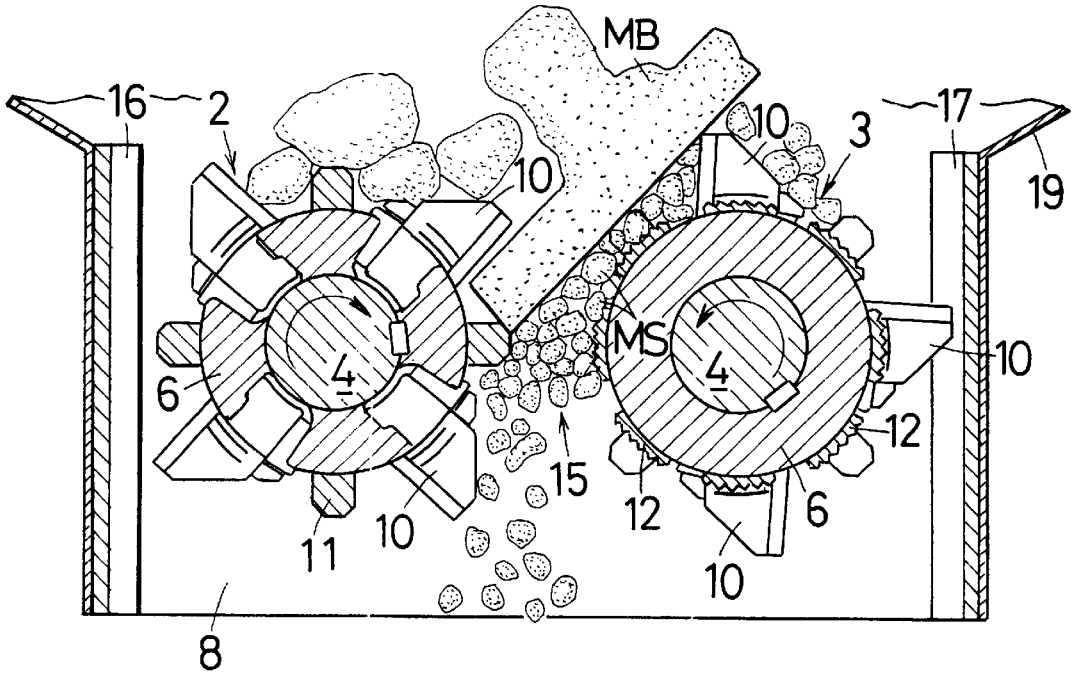
FIG. 7 is a sectional view showing an example of a crushing process by interaction between odd-shaped material and material of small particle diameter.

Accordingly, plate material MP may be caught in the bottom 51 of the hopper 50, failing to be fed. The hopper 19 in the present invention is open and has no portion for guiding material directly above the crushing chamber 8. Therefore, crushing proceeds as shown below, by way of example. FIG. 7 is a sectional view showing an example of a crushing process by interaction between large odd-shaped material MB and material MS of small particle diameter. When material is thrown in the hopper 19, because there is no member for guiding material directly above the crushing chamber 8, the material is cast into the whole area of the crushing chamber 8 at random. At this time, because there are spaces between the breaking teeth 10, materials MS of small particle diameter are held in the spaces and thus loaded onto the outer peripheral surfaces of the first rotor 2 and the second rotor 3 (see FIG. 7). The loaded materials MS are transferred toward the crushing space 15 by the rotation of the two rotors.

The first rotor 2 and the second rotor 3 rotate in the opposite directions to each other, and materials MS of small particle diameter are pressed by the compression teeth 11 against the compression teeth 11 or the cutting teeth 12 on the other rotor, thereby causing compressive crushing. When materials MS of small particle diameter clog the crushing space 15 and stay therein, the cutting teeth 12 on the respective rotors cut the materials MS to form a gap, thereby allowing them to drop and thus canceling the clogging.

Large odd-shaped material MB contacts the wedge surfaces 20 of the breaking teeth 10 because the breaking teeth 10 have the greatest diameter and is transferred toward the crushing space 15. The breaking teeth 10 on both the first rotor 2 and the second rotor 3 can move materials toward the crushing space 15, that is, toward an intermediate region between the first rotor 2 and the second rotor 3, by similar action without guiding them with a hopper or the like. Accordingly, even large odd-shaped material MB assumes a posture such as that shown in FIG. 7, i.e. it is caught between the breaking teeth 10 of the first rotor 2 and the second rotor 3. The large odd-shaped material MB is moved to the crushing space 15 by the breaking teeth 10 and crushed or cut by the wedge effect.

Figure 8:
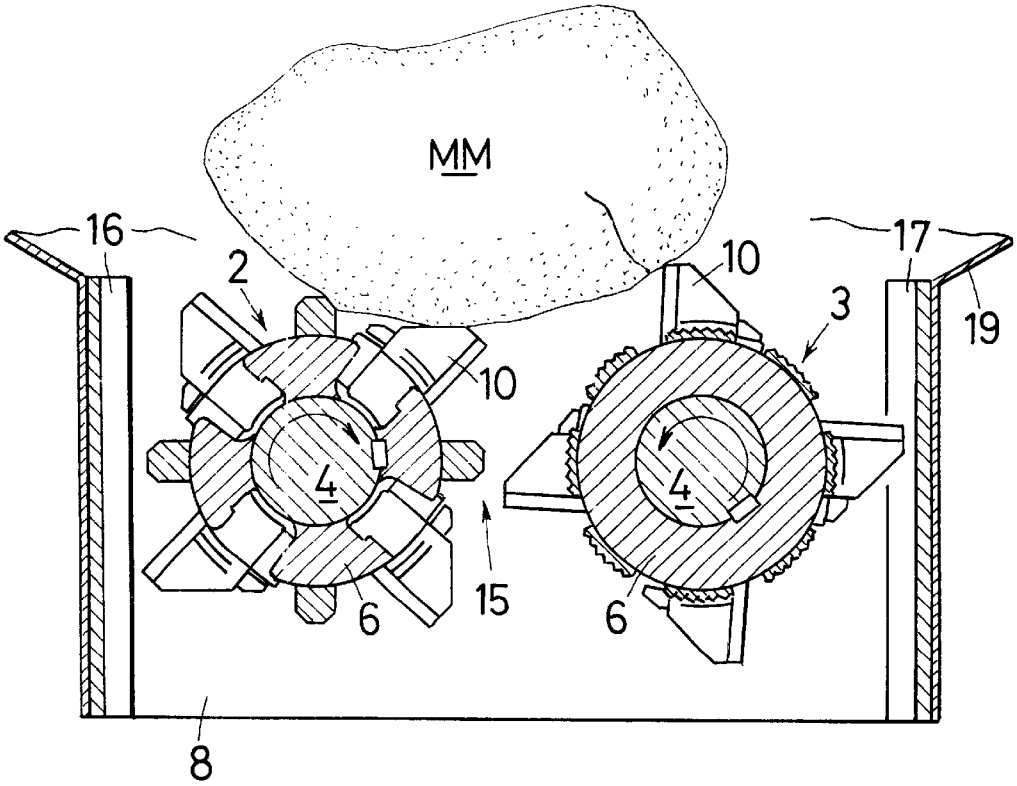
FIG. 8 is a sectional view showing an example of a process of crushing large lump material.

FIG. 8 is a diagram showing the way in which a large lump material MM of the maximum size is broken. When such a large lump material MM is thrown into the hopper 19, the breaking teeth 10 on the first rotor 2 and the second rotor 3 mainly receive and support the largest material MM. Accordingly, the distal ends of the breaking teeth 10 repeatedly bite into the largest material MM by the wedge effect. Consequently, the large lump material MM is cracked or cut away little by little to reduce in diameter gradually.

Figure 9:
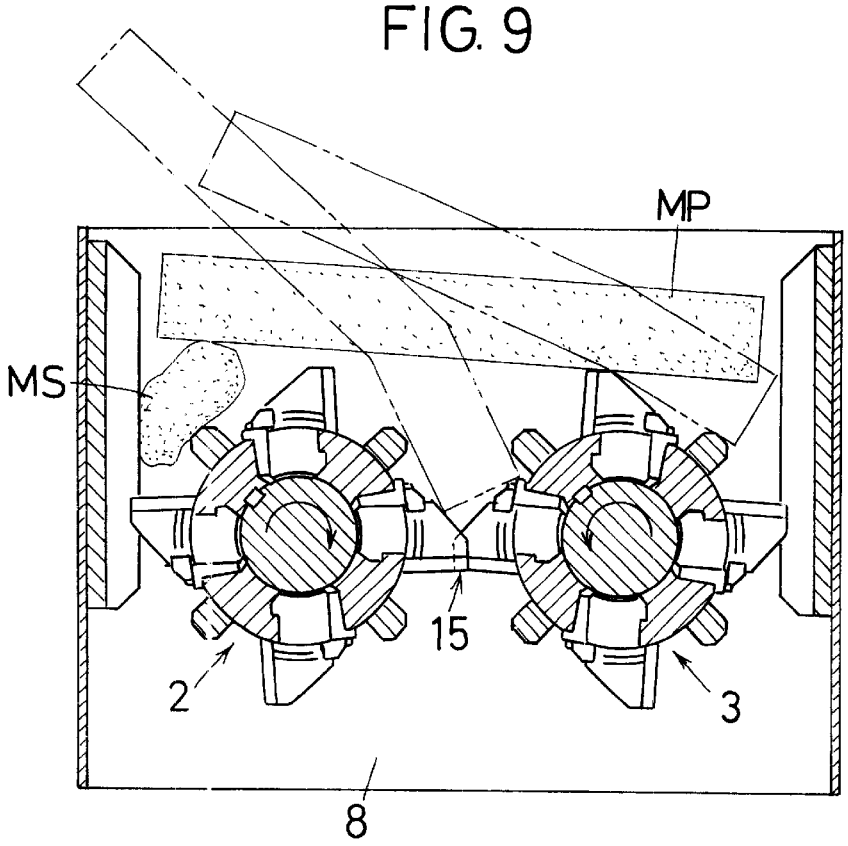
FIG. 9 is a sectional view showing an example of a process of crushing plate material covering both a first rotor and a second rotor.
Figure 10:
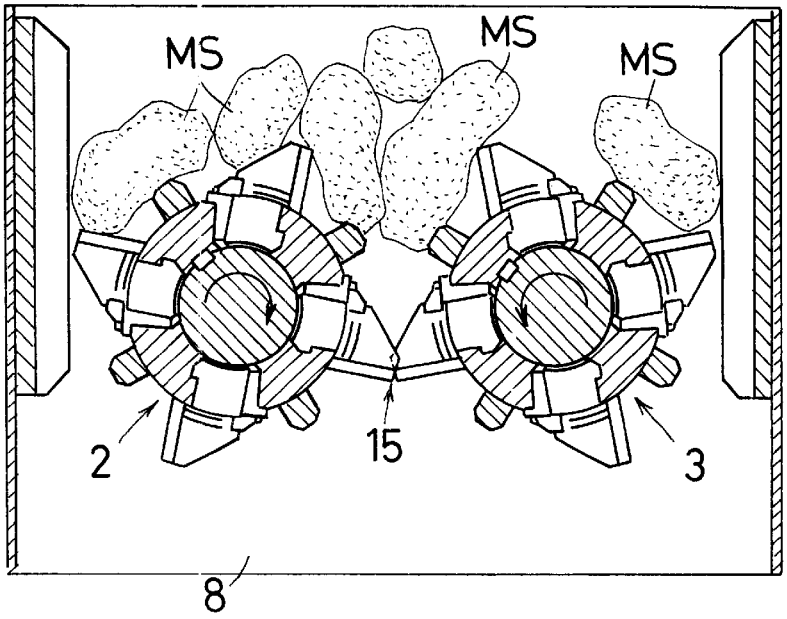
FIG. 10 is a sectional view showing a crushing process in which small lump materials crush each other.

FIG. 9 is a sectional view showing a crushing process carried out when the above-described plate material MP covers both the first rotor 2 and the second rotor 3. Small lump material MS caught between the breaking teeth 10 of the first rotor 2 and the second rotor 3 pushes up the plate material MP to erect it as the rotors 2 and 3 rotate. Eventually, the plate material MP is transferred to the crushing space 15 between the first rotor 2 and the second rotor 3 to assume a readily crushable posture. The sectional view of FIG. 10 is a process drawing showing an example of crushing between small lump materials MS. Small lump materials MS caught between the breaking teeth 10 of the first rotor 2 and the second rotor 3 contact and crush each other.

It should be noted that when the crushing resistance has increased in excess of the load limit of the prime mover for driving the first rotor 2 and the second rotor 3, the prime mover is reversed to rotate the first rotor 2 and the second rotor 3 in the reverse direction. It is also possible to readily change the direction for biting into the material by having the function of rotating one rotor in the forward direction and the other rotor in the reverse direction.

Second Embodiment

Figure 6:
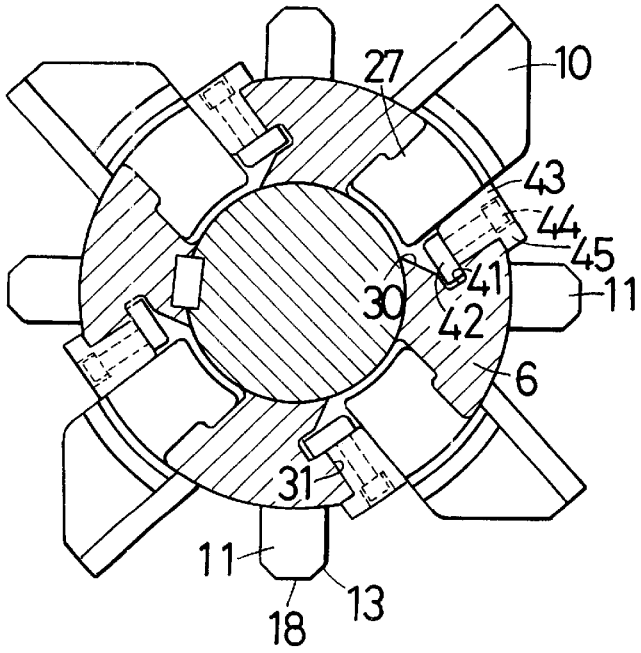
FIG. 6 is a sectional view showing another mounting structure of breaking teeth.

FIG. 6 is a sectional view showing another mounting structure for breaking teeth. A fixing member engagement hole 41 is formed in a side surface of each breaking tooth fixing hole 30. One end of a cotter fixing member 42 is inserted into the fixing member engagement hole 41. A breaking tooth mounting cotter 43 is inserted into the gap between the insert portion 27 of a breaking tooth 10 and the slant surface 31. The breaking tooth mounting cotter 43 has an L shape and is tapered at the distal end. Accordingly, when the breaking tooth mounting cotter 43 is forced into the gap between the insert portion 27 and the slant surface 31 of the breaking tooth fixing hole 30, the breaking tooth 10 is fixed in the breaking tooth fixing hole 30.

A collar 45 at the upper end of the breaking tooth mounting cotter 43 is in contact with the outer peripheral surface 7 of the first rotor body 6. A tapped hole is formed to extend from the top surface of the collar 45 toward the cotter fixing member 42. A bolt 44 is screwed into the tapped hole. By screwing the bolt 44 into the cotter fixing member 42, the cotter fixing member 42 and the breaking tooth mounting cotter 43 are secured together as one unit. Because coupling is effected by thread engagement, attachment and detachment are facilitated.

Other Embodiments

Although the roll crushers according to the foregoing embodiments are of the twin-shaft type having the first rotor 2 and the second rotor 3, the present invention is also applicable to other types, e.g. a single-shaft type, a type of crushing by a combination of a fixed tooth plate and a single shaft, a type of crushing by a combination of a single shaft and a repulsion plate, a three-shaft type, and a four-shaft type. In the foregoing embodiments, three kinds of teeth, i.e. breaking teeth 10, compression teeth 11, and cutting teeth 12, are installed on the outer peripheral surface 7 of the first rotor body 6. However, it is also possible to install only breaking teeth 10 and compression teeth 11 or only breaking teeth 10 and cutting teeth 12.

As has been detailed above, the roll crusher according to the present invention can crush material regardless of the shape thereof. In addition, among a plurality of kinds of crushing teeth, breaking teeth that perform mainly breaking are arranged so that reaction force acting thereon is received at two separate positions. Therefore, mounting rigidity is high.

It should be noted that the present invention is not necessarily limited to the foregoing embodiments but can be modified in a variety of ways without departing from the gist of the present invention.

What is claimed is:

1. A roll crusher having a plurality of kinds of crushing teeth for crushing a material to be crushed on an outer periphery of a rotor driven to rotate, said roll crusher comprising:

a cylindrical rotor body;

a plurality of breaking teeth for crushing said material mainly by a wedge effect, said breaking teeth being installed on an outer periphery of said rotor body, and said breaking teeth each having a pair of wedge surfaces contiguous to each other with an angle converging in a rotational direction;

a plurality of compression teeth for crushing said material mainly by a compressive effect, said compression teeth being installed on the outer periphery of said rotor body, and said compression teeth each having a plane portion; and a plurality of cutting teeth for crushing said material mainly by cutting, said cutting teeth being installed on the outer periphery of said rotor body, and said cutting teeth each having a cutting edge.

2. A roll crusher according to claim 1, wherein said breaking teeth, said compression teeth and said cutting teeth are different in radial height from the outer peripheral surface of said rotor body.

* * * * *